US008798113B2

(12) United States Patent
Dung

(10) Patent No.: US 8,798,113 B2
(45) Date of Patent: Aug. 5, 2014

(54) WALL ELEMENTS FOR WATER-COOLED, CURRENT-CONDUCTING ELECTRODE BEARING ARMS AND ELECTRODE BEARING ARMS PRODUCED FROM SUCH WALL ELEMENTS

(76) Inventor: Arndt Dung, Hagen (DE)

( * ) Notice: Subject to any disclaimer, the term of this patent is extended or adjusted under 35 U.S.C. 154(b) by 1122 days.

(21) Appl. No.: 12/303,254

(22) PCT Filed: Jun. 13, 2007

(86) PCT No.: PCT/EP2007/005198

§ 371 (c)(1),
(2), (4) Date: Dec. 3, 2008

(87) PCT Pub. No.: WO2007/144154

PCT Pub. Date: Dec. 21, 2007

(65) Prior Publication Data

US 2009/0207877 A1 Aug. 20, 2009

(30) Foreign Application Priority Data

Jun. 13, 2006 (DE) ..... 10 2006 027 648

(51) Int. Cl.
*H05B 7/10* (2006.01)
*H05B 7/101* (2006.01)

(52) U.S. Cl.
USPC ..... 373/94; 373/98; 373/99

(58) Field of Classification Search
USPC ..... 373/52, 53, 94, 95, 98, 99, 100, 96
See application file for complete search history.

(56) References Cited

U.S. PATENT DOCUMENTS

| | | | | | |
|---|---|---|---|---|---|
| 3,602,624 | A | * | 8/1971 | Turner et al. | 373/99 |
| 4,182,927 | A | * | 1/1980 | Phillips | 373/99 |
| RE30,521 | E | * | 2/1981 | Faulkner et al. | 373/37 |
| 4,682,341 | A | * | 7/1987 | Ehle et al. | 373/99 |
| 5,200,974 | A | * | 4/1993 | Kark et al. | 373/94 |
| 5,471,496 | A | | 11/1995 | Becker et al. | |

FOREIGN PATENT DOCUMENTS

| | | | |
|---|---|---|---|
| AT | 157839 | T | 9/1997 |
| BR | 9301181 | A | 11/1994 |
| DE | 4236158 | C1 | 3/1994 |
| DE | EP0594272 | A1 | 4/1994 |
| ES | 2106269 | T3 | 11/1997 |
| GB | 2271836 | A | 10/1993 |
| JP | 622396 | A | 12/1994 |
| SG | 52327 | A1 | 9/1998 |

OTHER PUBLICATIONS

European Patent Office, International Search Report, PCT/EP2007/005198, Sep. 20, 2007, Rijswijk, NL.

* cited by examiner

*Primary Examiner* — Henry Yuen
*Assistant Examiner* — Hung D Nguyen
(74) *Attorney, Agent, or Firm* — Louis Ventre, Jr.

(57) ABSTRACT

A support arm for a water-cooled, current-conducting electrode includes wall elements, wherein each wall element is a flat conductive metal with a hollowed out recess on its outer surface extending over its length. The support arm further includes a cover extending over each recess to define a closed cooling channel within each wall element when the cover is welded to the wall element. The cover includes with an inlet port and an outlet port for cooling water.

7 Claims, 4 Drawing Sheets

Figure 1A:
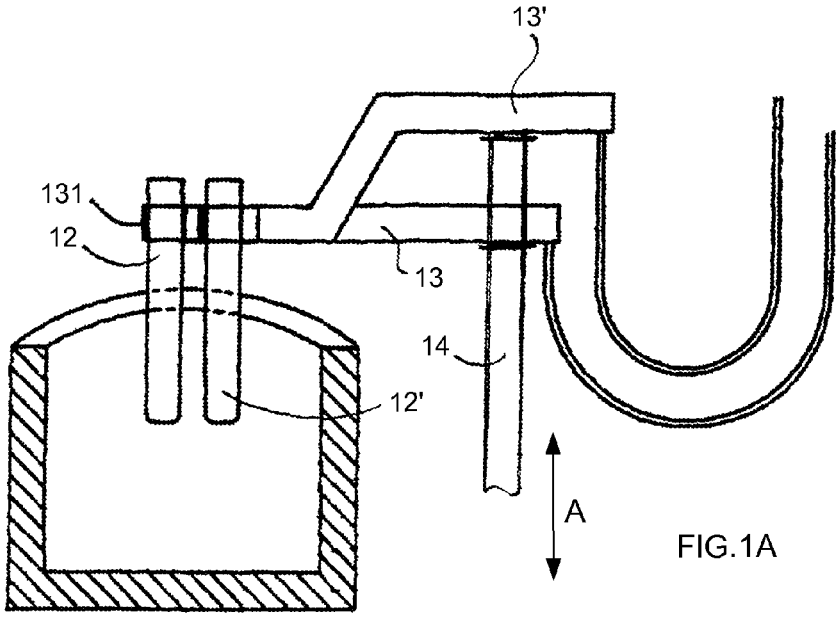

WALL ELEMENTS FOR WATER-COOLED, CURRENT-CONDUCTING ELECTRODE BEARING ARMS AND ELECTRODE BEARING ARMS PRODUCED FROM SUCH WALL ELEMENTS

The invention relates to wall elements for water-cooled, current-conducting electrode support arms, and electrode support arms produced from such wall elements.

Support arms for the electrodes of electric arc furnaces require water cooling, at least in the vicinity of the furnace vessel, due to the high temperatures resulting from the melting process. In this regard it has been proposed in the past to have water impinge on the electrode support arm itself, which is designed as a hollow body, and also to associate tubes, which conduct cooling water and pass through the support arm, with the electrode support arm which is designed as a hollow body (EP 0 061 612 B1, U.S. Pat. No. 3,602,624, U.S. Pat. No. 3,686,421). As a result of the direct impingement of cooling water on the interior of the electrode support arm which is designed as a hollow body, with consideration for the fact that the support arm must have sufficient buckling resistance, the dimensioning of the wall thickness of the support arm must be taken into account. The cooling which is also generally provided for the electrode tension bracket and the contact jaw requires independent feeding of cooling water to the electrode tension bracket and the contact jaw through tubes, associated with the electrode support arm, for supply and discharge of the cooling water for the electrode tension bracket and the contact jaw. For the cooling water feed it has also been recently proposed for the extruded wall elements forming the electrode support arm to be provided with boreholes for the circulation of cooling water (EP 0 594 272 B2). In this case the separate tubing systems which pass through the electrode support arm or which are combined with the support arm are dispensed with. However, the complex production of the extruded wall elements having closed channels provided therein for the cooling water circuit has proven to be disadvantageous. This approach is also costly, since the production of wall elements with differing dimensions and/or cross sections of the cooling water channels requires separate tools which pass through the wall elements.

On the basis of the current art, the object of the present invention is to design a more economical cooling system which is integrated into wall elements which form electrode support arms, and which also allows more flexibility with regard to the cross sections of the wall elements and the cooling water channels.

The object is achieved by using wall elements for water-cooled, current-conducting electrode support arms which according to the invention comprise a flat profile made of an electrically conductive metal, and into which at least one recess is incorporated on the flat side forming the outside of the electrode support arm, the recess extending over the length of the profile and being provided on the outer and end face sides with covers which are combined with the flat profile by welding and which result in a closed cooling channel, and which in each case have at least one inlet and at least one outlet for the cooling water flowing through the cooling channel.

Embodiments of the wall element according to the invention result from subclaims 2 through 7. Subclaims 8 through 11 are concerned with electrode support arms which may be produced from the wall elements according to the invention.

Figure 1B:
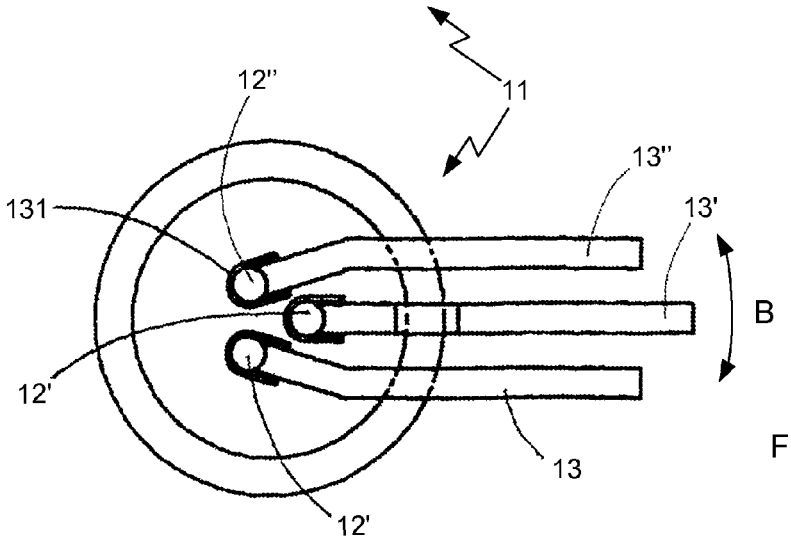
Figure 2A:
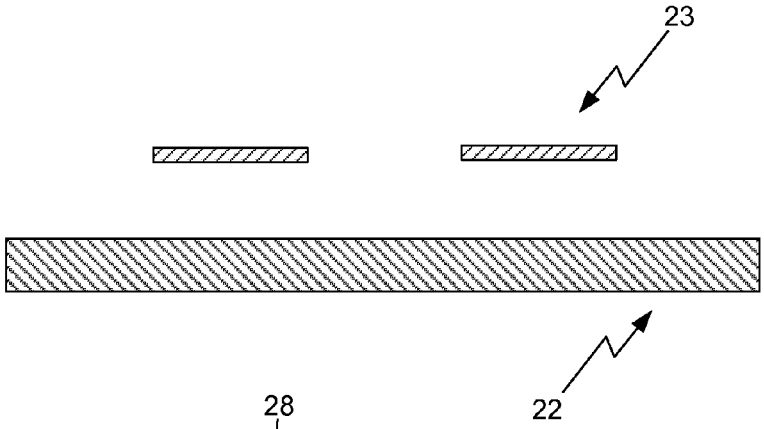
Figure 2B:
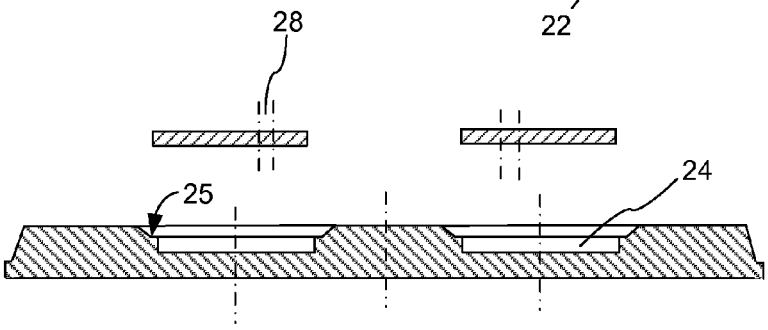
Figure 2C:
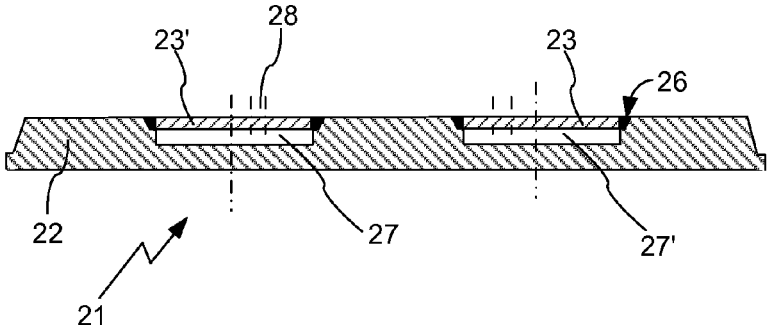
Figure 3A:
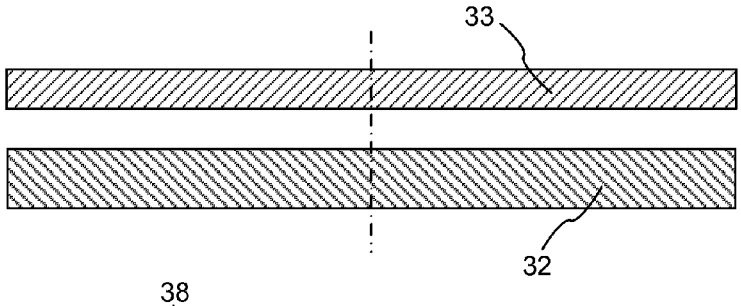
Figure 3B:
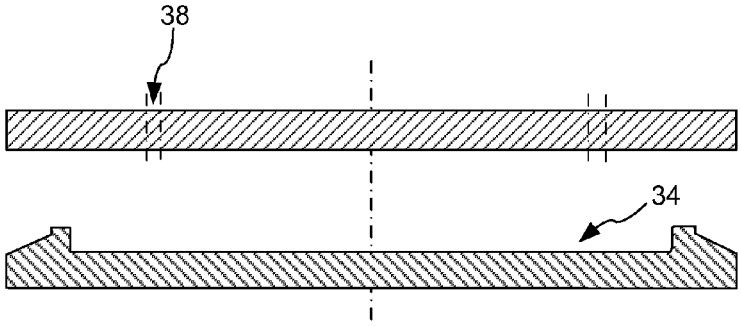
Figure 3C:
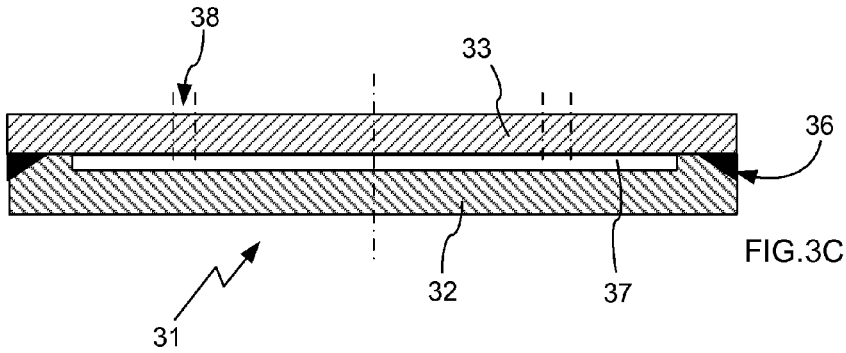
Figure 5:
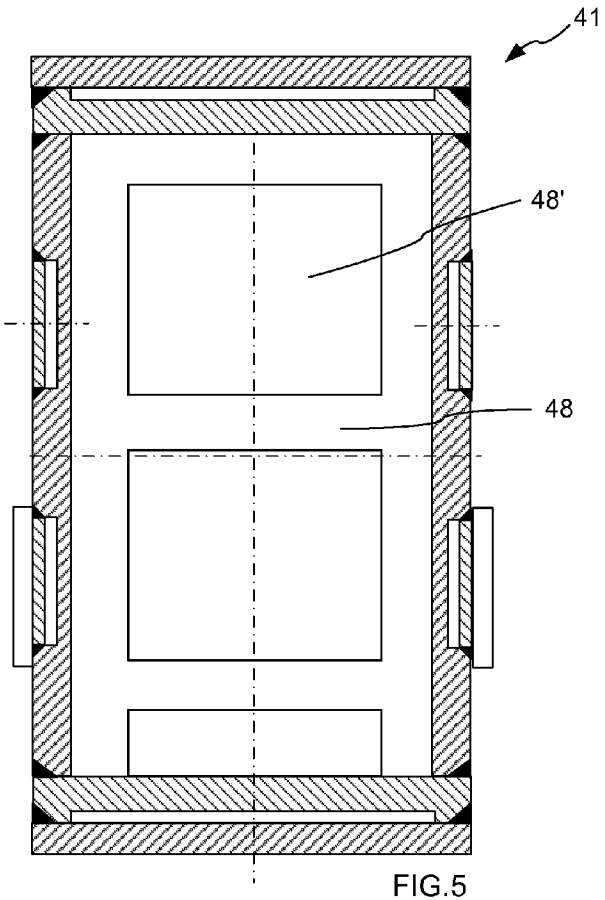
Figure 4:
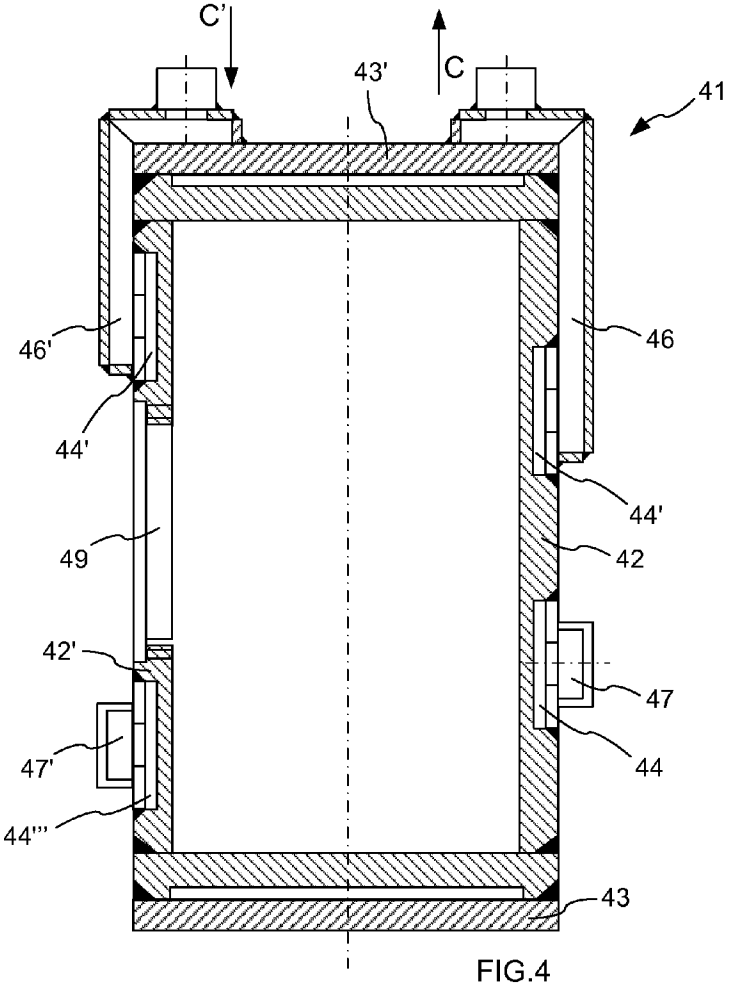

The invention is explained in greater detail with reference to one exemplary embodiment in the drawings, which show the following:

FIGS. 1*a* and 1*b* show the schematic illustration of an electric arc furnace melting unit;

FIG. 2*a* shows the cut starting material for the side walls of the electrode support arm, in one cross section;

FIG. 2*b* shows an illustration corresponding to FIG. 2*a*, with recesses milled into the base body of the wall element;

FIG. 2*c* shows the completed wall element according to the invention;

FIG. 3*a* shows the cut starting material for the lower and upper wall elements of the electrode support arm, in one cross section;

FIG. 3*b* shows an illustration corresponding to FIG. 3*a*, with a recess milled into the base body;

FIG. 3*c* shows the completed wall element;

FIG. 4 shows a cross section, in the vicinity of the furnace vessel, of an electrode support arm produced from wall elements according to the invention; and FIG. 5 shows a cross section corresponding to FIG. 4, in the vicinity of the furnace vessel, of the electrode support arm.

In the electric melting unit schematically illustrated in FIGS. 1*a* and 1*b*, reference numeral 11 denotes the furnace vessel in which the generally used scrap metal is melted under the influence of the electrodes 12, 12', 12" lowered into the furnace vessel. The electrodes 12, 12' 12" are clamped (131) to the free end of the electrode support arms 13, 13', 13", are lowered during the melting process corresponding to the progressive burnoff, and after advanced burnoff are replaced. For emptying of the furnace vessel 11 after the melting process is completed, generally by tilting the furnace vessel 11, as well as for replacement of the electrodes, the electrodes 12, 12', 12" must be lowered and raised, and then must be swiveled out of the immediate vicinity of the furnace vessel 11. For this purpose, the electrode support arms 13, 13', 13" are supported on a support arm column 14 so as to allow lowering and raising as indicated by double arrow A, and to allow horizontal swiveling as indicated by double arrow B. The electrode support arms and the tension brackets 131 for the electrodes 12, 12', 12" located at the free end of the electrode support arms 13, 13', 13" require intensive cooling, generally using cooling water which is led through the support arms and the tension brackets, due to the high temperatures occurring in the surroundings of the furnace vessel 11 during the melting process.

Components of the wall elements according to the invention for electrode support arms which are cut from continuous material are illustrated in FIGS. 2*a* and 3*a*. These components comprise the base bodies 22, which form the wider side walls, the base bodies 32 of lesser width, which form the lower and upper walls of the electrode support arms, and the low-thickness covers 23, 23', and 33, which complete the wall elements. FIGS. 2*b* and 3*b* show the respective base bodies 22 and 32 of wider wall element 21 and narrower wall element 31 with milled-in recesses 24 and 34. FIGS. 2*c* and 3*c* show the respective completed wider wall element 21 and narrower wall element 31 together with the cooling water channels 27, 27', and 37 provided therein. The remaining combination of the cover 23 with the base body 22 of the wider wall element 21 by means of indented depression 25 welding seams 26 is shown in FIG. 2*c*. The components of the remaining narrower wall element 31 shown in FIG. 3*c* are combined in a corresponding manner. The covers 23, 23', and 33 (indicated in dashed lines) have respective boreholes 28 and 38 as required for connecting inlet, outlet, and transfer lines for the water flowing through the cooling channels 27, 27', and 37. The thickness of each the wall element is in a range of 20 to 70 millimeters.

In the cross section of an electrode support arm 41 produced from wall elements according to the invention in the furnace vicinity shown in FIG. 4, the wall elements forming the side walls of the electrode support arm are denoted by reference numerals 42, 42', and the wall elements forming the lower and top sides of the electrode support arm are denoted by reference numerals 43, 43'. Cooling water which impinges on the support arm as well as the electrode tension bracket passes through the cooling channels 44 . . . , 44''' provided in the side walls 42, 42'. The feed and discharge of the cooling water to and from the electrode tension bracket (not illustrated) is indicated by the arrow sequence C-C'. In a special case, the side walls 42, 42' and the wall elements 43, 43' forming the lower side and top side of the electrode support arm, as well as the electrode tension bracket and the contact jaw, are independently impinged with cooling water. However, the cooling water impingement may also be jointly combined via corresponding branches provided in the cooling channels of the side walls. Reference numerals 46, 46' denote the furnace-side connections for the cooling water circuit in the electrode tension bracket which are situated at the cooling channels 44', 44" in the side walls 42, 42'. Connections for branches of one section with one of several other sections of the cooling channels 44 . . . , 44''' which extend over the length of the side walls and which are divided into sections are denoted by reference numerals 47, 47'. The region denoted by reference numeral 49 is the modification region of the electrode support arm which may be added.

FIG. 5 shows the reinforcement of the electrode support arm by means of partitions 48 inserted into same, which are provided with cutouts 48' for the purpose of weight reduction. The design of the wall thicknesses of the electrode support arm depends on the particular application, and also on the design of the cooling channel cross sections.

The preferential cooling of the electrode support arm via the cooling channels provided in the support arm walls does not exclude cooling of the region of the electrode support arm adjoining the furnace via the feeding of cooling water into partitioned regions in the vicinity of the furnace. The cooling water circuit also results from inlets and outlets for channels which extend in walls of the electrode support arm and which conduct the cooling water.

LIST OF REFERENCE NUMERALS

11 Furnace vessel
12, 12', 12" Electrodes
13, 13', 13" Electrode support arms
131 Clamps, tension bracket
14 Support arm column
21 Wider wall element
22 Base body
23 Cover
24 Recess
25 Depression
26 Welding seams
27, 27' Cooling channels
28 Boreholes
31 Narrower wall element
32 Base body
33 Cover
34 Recess
36 Welding seam
37 Cooling channel
38 Boreholes
41 Electrode support arm
42, 42' Side walls
43, 43' Base and top walls
44 . . . , 44''' Cooling channels
45 Welding seams
46, 46' Furnace-side connections
47, 47' Additional connections
48 Partitions
48' Cutouts
49 Modification region
A Support arm lift
B Support arm swivel
C Cooling water feed
C' Cooling water return

The invention claimed is:

1. A support arm for a water-cooled, current-conducting electrode comprising:

a plurality of wall elements, wherein each wall element in the plurality of wall elements comprises a flat conductive metal having a length, a width; and a thickness;

said plurality of wall elements comprising:

two wider side walls of the support arm, each wider side wall formed with a plurality of milled-in recesses; and two narrower lower and upper walls of the support arm, each narrower lower and upper wall having a milled-in recess;

a cover for each said wall element, said cover extending over the milled-in recess to define a closed cooling channel within the wall element when said cover is welded to the wall element; and each said cover configured with an inlet port and an outlet port for cooling water; wherein the plurality of wall elements are made of aluminum or an aluminum alloy; and wherein each milled-in recess is configured with depressions formed into a boundary region surrounding the milled-in recess; and wherein each cover when positioned within said milled-in recess can be welded to the wall element in said boundary region such that the cover is flush with outside surface of the electrode support arm.

2. The support arm according to claim 1, wherein said thickness of each said wall element is in a range of 20 to 70 millimeters.

3. The support arm according to claim 1, further comprising a second closed cooling channel extending at a distance from the closed cooling channel, said second closed cooling channel extending over the length of the wall element.

4. The support arm according to claim 1, further comprising:

an electrode tension bracket; and connections for impingement of cooling water on the electrode tension bracket, said connections adapted to be mounted on the support arm at the free end of the electrode support arm.

5. The support arm according to claim 1, further comprising partitions within the electrode support arm at a distance from one another and supported on the wall elements.

6. The support arm according to claim 5, wherein the partitions are configured with a cutout forming a frame.

7. The support arm according to claim 1, wherein wall elements are joined together by means of indented welding seams.

* * * * *